US006505613B1

(12) United States Patent
Albertson

(10) Patent No.: US 6,505,613 B1
(45) Date of Patent: Jan. 14, 2003

(54) AIR ASSIST FUEL INJECTION SYSTEM WITH COMPRESSOR INTAKE THROTTLE CONTROL

(75) Inventor: William Conrad Albertson, Clinton Township, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/939,142

(22) Filed: Aug. 27, 2001

(51) Int. Cl.[7] ..... F02M 67/02
(52) U.S. Cl. ..... 123/533; 417/295; 123/494
(58) Field of Search ..... 123/531, 533, 123/456, 494; 417/295, 300

(56) References Cited

U.S. PATENT DOCUMENTS 4,899,714 A * 2/1990 Schechter et al. ..... 123/533
5,156,133 A * 10/1992 Sugimoto et al. ..... 123/533
6,123,510 A * 9/2000 Greer et al. ..... 417/53
6,286,469 B1 * 9/2001 Cobb, Jr. ..... 123/73 C
6,357,422 B1 * 3/2002 Doane et al. ..... 123/458

* cited by examiner

*Primary Examiner*—Carl S. Miller
(74) *Attorney, Agent, or Firm*—Leslie C. Hodges

(57) ABSTRACT

An air-assisted fuel injection system for an engine includes an air compressor to be driven by the engine and having an air inlet and an air outlet connected with air-assisted fuel injectors for the engine. An air pressure regulator is also connected with the compressor outlet for controlling air pressure by exhausting excess air delivered by the compressor to the outlet. A throttle valve in the compressor inlet is operated by a controller to variably restrict inlet air flow to the compressor. An air flow sensor, responsive to an indicator of the flow of excess air exhausted by the air pressure regulator, is connected with the controller for variably closing the throttle in response to increasing excess air flow, thereby reducing the amount of excess air delivered by the compressor and limiting parasitic losses from pumping of excess air by the compressor.

5 Claims, 2 Drawing Sheets

AIR ASSIST FUEL INJECTION SYSTEM WITH COMPRESSOR INTAKE THROTTLE CONTROL

TECHNICAL FIELD

This invention relates to air assist fuel injection systems and more particularly to throttle control of the compressor air intake in such systems.

BACKGROUND OF THE INVENTION

It is known in the art to provide direct injection of fuel to the cylinders of an internal combustion engine using air-assisted fuel injection wherein compressed air is provided to assist in the injection of fuel into the cylinders. A compressor for providing compressed air for such a system may be directly driven by the engine so that the compressor speed varies directly with that of the engine. However, the output flow of the engine-driven compressor is not linear with the engine speed related requirement for proper fuel delivery. Accordingly, the air compressor displacement is sized for the greatest flow demand in the engine speed/load matrix plus a factor for expected deterioration of the system over time.

Because of this over capacity, an air pressure regulator is utilized to control the system pressure at a nominal pressure level and to exhaust excess air flow supplied by the compressor. The result is that the compressor operates most of the time with considerable excess air flow which is parasitic in that it consumes excess energy in pumping air not needed for operation of the engine. Accordingly, an improved system for reducing the parasitic losses caused by excess air flow of the compressor with a minimum of additional cost is desired.

SUMMARY OF THE INVENTION

The present invention provides an improved air-assisted fuel injection system wherein the compressor air inlet includes an inlet flow regulating device, such as a throttle, wherein the throttle is controlled in response to the exhaust air flow from the air pressure regulator. The system operates to provide a low nominal exhaust air flow from the air pressure regulator by controlling the throttle position in the intake of the air compressor. An air flow indicator associated with the air pressure regulator connects through a feedback system with a controller for variably closing or opening the throttle in response to increasing or decreasing excess air flow from the pressure regulator.

If the air pressure regulator exhaust flow is too high, the feedback system and controller operate to restrict the input air flow to the compressor by moving the throttle in a closing direction. If the regulator exhaust flow is too low, the feedback system operates with the controller to open the throttle and increase air flow to the compressor. In this way, equilibrium at a prescribed low nominal regulator exhaust flow is reached quickly, within a few compressor cycles.

Various forms of air flow sensors or indicators could be used. Some examples are an air flow meter measuring exhaust flow from the pressure regulator and a position transducer measuring movement of a pressure responsive diaphragm valve or other member in the pressure regulator.

These and other features and advantages of the invention will be more fully understood from the following description of certain specific embodiments of the invention taken together with the accompanying drawings.

DESCRIPTION OF THE PREFERRED EMBODIMENT

Figure 1:
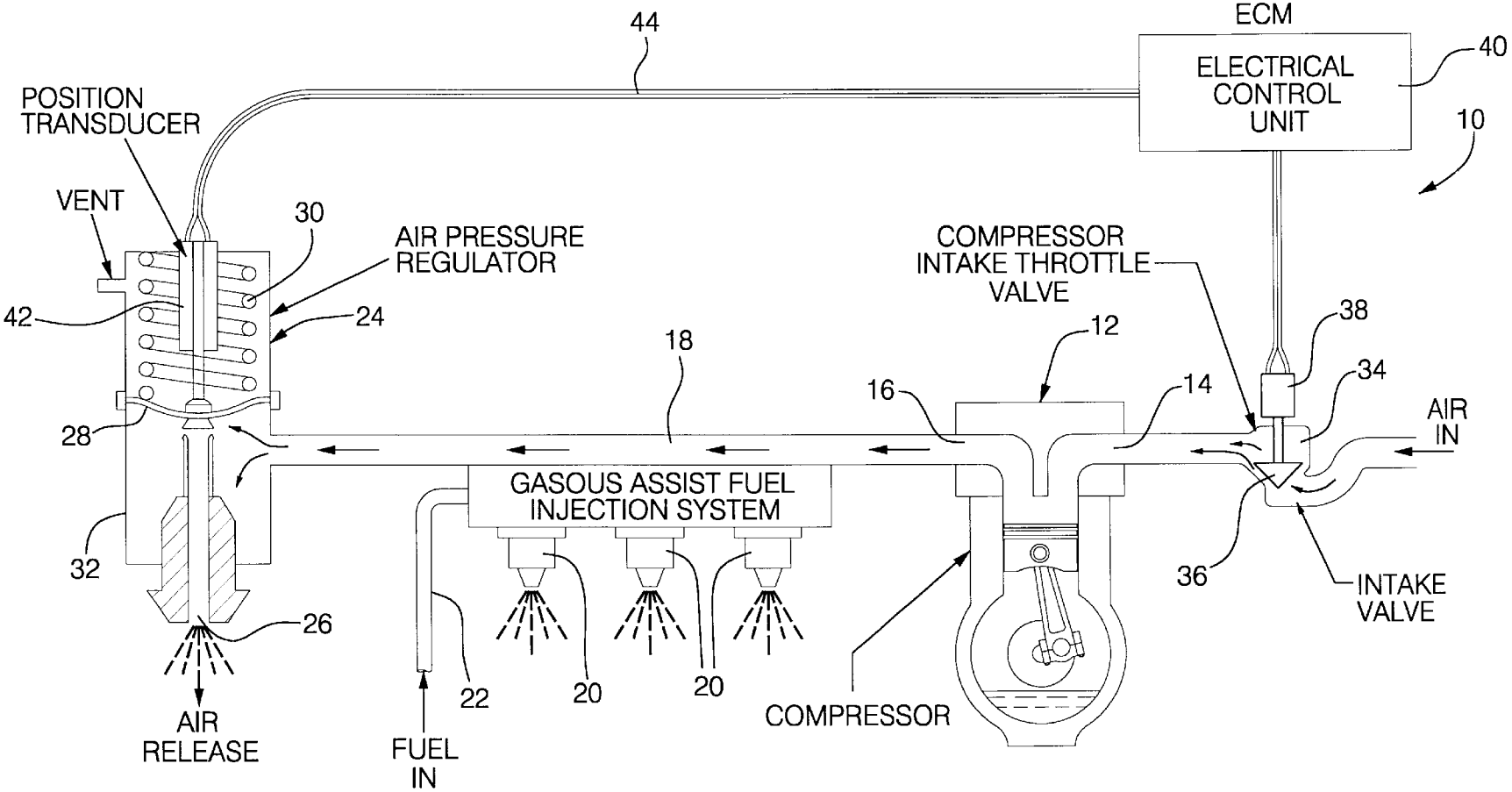
FIG. 1 is a diagrammatic view of an air-assisted fuel injection system according to the invention including a first embodiment of air flow indicator.

Referring now to the drawings in detail, numeral 10 generally indicates a first embodiment of an air-assisted fuel injection system according to the invention. System 10 includes an air compressor 12 having an air inlet 14 and an air outlet 16. Air outlet 16 connects through an air supply line 18 with multiple injectors 20 that are supplied with fuel by a fuel supply line 22 and receive compressed air from the air supply line 18.

The air supply line 18 also connects with an air pressure regulator 24. The regulator controls the air pressure in the air supply line 18 by exhausting excess air, not used by the injectors, through an exhaust port 26. Any suitable form of air pressure regulator may be used; however, the drawings indicate a diaphragm valve 28, biased closed by a spring 30 and openable in response to pressure within a housing 32 forming a chamber below the diaphragm. As the excess air pressure in the housing 32 is increased, the diaphragm is raised to open the diaphragm valve 28 to exhaust increasing amounts of air so that the pressure in the air supply line 18 remains relatively constant in spite of varying compressor speeds and varying air demands by the injectors.

The air inlet 14 connects with a throttle valve 34 that is closeable to restrict air flow to the compressor inlet 14. Any suitable form of a throttle valve may be utilized; however, the drawings indicate an electrically-actuated plunger valve having a reciprocating valve element 36 driven by an electric actuator, such as a motor 38. The motor is controlled by an electrical control unit 40 under the control of, or forming a portion of, the electrical control module (ECM) of a vehicle.

In the pressure regulator 24, a position transducer 42 monitors movement of the diaphragm valve and forms an indicator of air flow out of the valve which varies in response to the opening and closing of the diaphragm valve. The transducer is connected by a feedback line 44 with the electrical control unit 40 to comprise an air flow sensor feeding an air flow signal to the electrical control unit for use in determining the positioning of the inlet throttle valve 34 by actuation of the valve element 36 by the actuator 38.

In operation, the air compressor draws outside air in through the open throttle valve 34 and supplies compressed air through supply line 18 to the injectors 20. The air pressure regulator is actuated open by the pressure of excess air not used by the injectors which enters the housing 32. The presence of an adequate control pressure in the housing opens the diaphragm valve 28 to exhaust excess air through the exhaust port 26.

If the flow of excess air is more than a nominal amount which is needed for flow control, the diaphragm valve will open further to exhaust the additional excess air through the port 26. The transducer 42 will then send a feedback signal to the electrical control unit 40 indicating that the compressor is supplying more air than necessary. The electrical control unit will then energize the actuator to partially close the throttle valve 34 to restrict air flow through the inlet 14 of the compressor. This will reduce the amount of air flow handled by the compressor and reduce the excess air delivered to the air pressure regulator, resulting in a return of the diaphragm to the original position to provide the desired nominal amount of excess air flow.

Subsequently, as the amount of air used by the injectors varies and as the speed of the compressor varies with engine speed, increases and decreases in the amount of excess air delivered to the air pressure regulator will be converted, through the feedback and action of the electrical control unit, to closing or opening motions of the throttle valve 34. These valve motions vary the compressor outlet air flow as necessary to maintain exhaust air flow from the air pressure regulator at approximately the desired nominal amount. The partial closing of the compressor throttle valve 34 effectively reduces the load on the compressor so as to both reduce the excess air flow delivered by the compressor and to reduce the energy required by operation of the compressor, thereby providing more efficient operation of the system at a relatively low cost.

Figure 2:
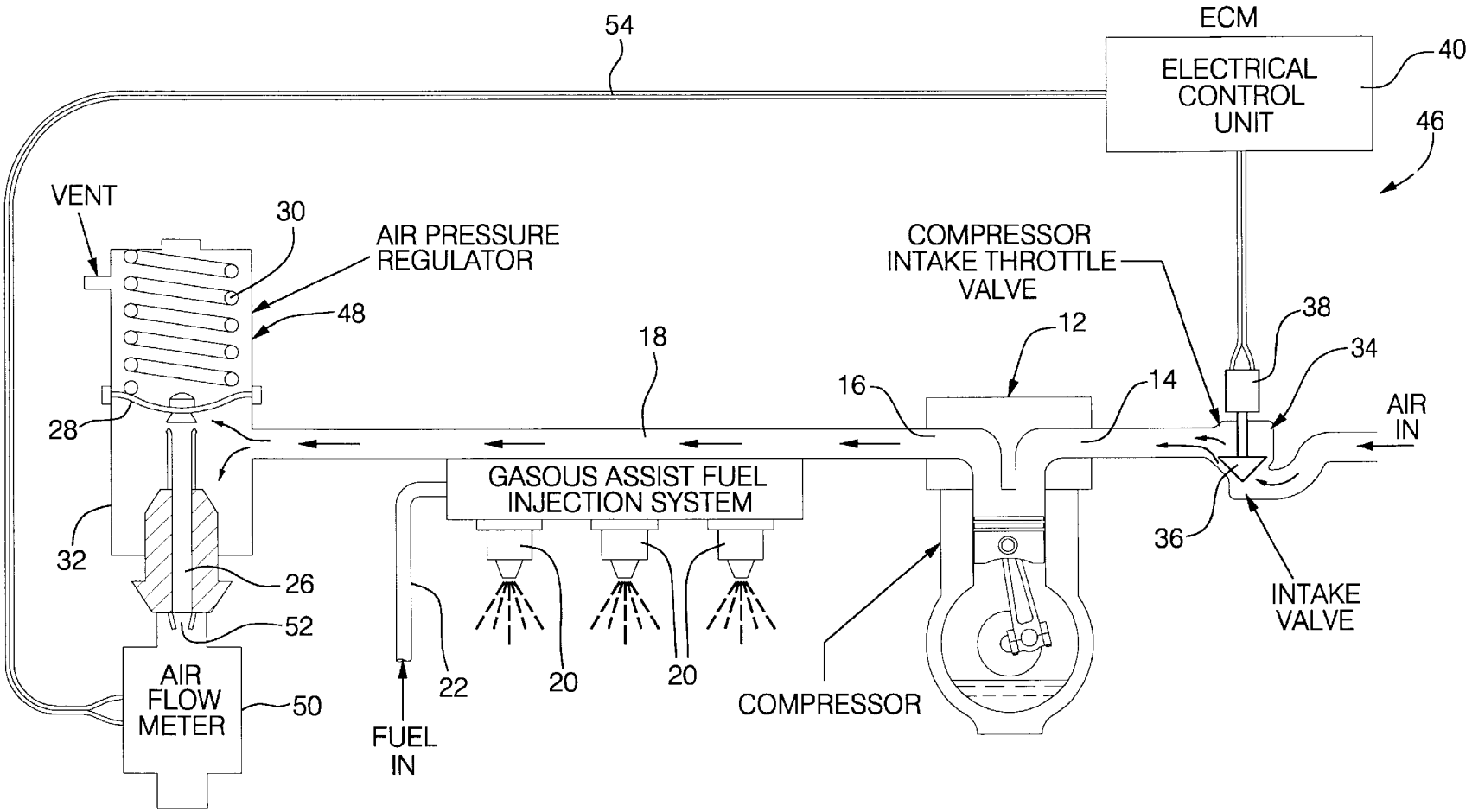
FIG. 2 is a view similar to FIG. 1 but showing a second embodiment of an air-assisted fuel injection system including an alternative air flow indicator.

Referring now to FIG. 2 of the drawings, there is shown an alternative embodiment of an air-assisted fuel injection system generally indicated by numeral 46. System 46 is in most respects similar to that of system 10 described above wherein like numerals indicate like parts. The system 46 differs in that the air pressure regulator 48 omits the position transducer of the prior embodiment and instead provides an air flow meter 50 in an exhaust passage connected with exhaust port 26 from the pressure regulator. Air flow meter 50 comprises the air flow indicator and sensor and is connected by a feedback line 54 to the electrical control unit 40. The control unit acts in the same fashion as the first embodiment to control the throttle valve 34 by moving the valve in a closing direction upon increased excess air flow and moving the valve in an opening direction upon reduction of excess flow to maintain a nominal amount of excess air flow as desired.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed is:

1. An air-assisted fuel injection system for an engine, the system including an air compressor adapted to be driven by the engine and having an air inlet and an air outlet, the outlet connected with air-assisted fuel injectors for the engine, and an air pressure regulator connected with the compressor air outlet for controlling air pressure in the outlet by exhausting excess air delivered by the compressor to the outlet, wherein the system further comprises:

a throttle valve in the compressor inlet and operable by a controller to variably restrict inlet air flow to the compressor; and an air flow sensor responsive to an indicator of the flow of excess air exhausted by the air pressure regulator, the sensor being connected with the controller for variably closing or opening the throttle in response to increasing or decreasing excess air flow, thereby controlling the amount of excess air delivered by the compressor and limiting parasitic losses from pumping of excess air by the compressor.

2. A system as in claim 1 wherein the controller responds to the sensor to substantially maintain a nominal flow of excess air from the pressure regulator over the range of air flow usage required by the fuel injectors.

3. A system as in claim 1 wherein the air flow sensor is a transducer monitoring the position of a pressure responsive member of the air pressure regulator.

4. A system as in claim 3 wherein the pressure responsive member is a diaphragm.

5. A system as in claim 1 wherein the air flow sensor is an air flow meter connected in an exhaust passage from the air pressure regulator.

* * * * *